United States Patent [19]

Matsutani

[11] Patent Number: 4,604,884

[45] Date of Patent: Aug. 12, 1986

[54] TWISTING APPARATUS OF ROOT CANAL REAMER OR FILE MATERIAL AND METHOD FOR MANUFACTURING ROOT CANAL REAMER OR FILE

[75] Inventor: Kanji Matsutani, Takanezawa, Japan

[73] Assignee: Matsutani Seisakusho, Japan

[21] Appl. No.: 627,538

[22] Filed: Jul. 3, 1984

[30] Foreign Application Priority Data

Jul. 4, 1983 [JP] Japan ..... 58-120268
Dec. 15, 1983 [JP] Japan ..... 58-237042

[51] Int. Cl.[4] ..... B21D 11/04

[52] U.S. Cl. ..... 72/299; 72/371; 72/64; 76/108 T

[58] Field of Search ..... 72/299, 298, 64, 65, 72/371; 76/108 T, 108 R, 5 R, 102

[56] References Cited

U.S. PATENT DOCUMENTS

| | | | |
|---|---|---|---|
| 274,943 | 4/1883 | Hooker | 76/108 T |
| 430,792 | 6/1890 | Taft | 76/108 T |
| 2,457,132 | 12/1948 | Delaney | 72/299 |
| 2,764,042 | 9/1956 | Götze | 76/108 T |
| 2,901,932 | 9/1959 | Erdelyi | 72/64 |
| 3,427,844 | 2/1969 | Bergström | 72/64 |
| 3,427,845 | 2/1969 | Evans | 72/64 |

FOREIGN PATENT DOCUMENTS

| | | | |
|---|---|---|---|
| 937566 | 1/1956 | Fed. Rep. of Germany | 72/108 R |
| 843281 | 6/1939 | France | 72/65 |

*Primary Examiner*—Daniel C. Crane
*Attorney, Agent, or Firm*—Basile, Weintraub & Hanlon

[57] ABSTRACT

An apparatus for the manufacture of a root canal reamer and a method of manufacture of the same. An apparatus for twisting reamer material has a triangular or rectangular cross-sectional opening, a chuck portion holding root part of taper-like reamer material and vice composed of a plurality of vice-claws capable of pressing side faces of reamer material while rotating. The distance between vice-claws and chuck is variable. The vice-claws adjacent to said vice are arranged alternately and are able to be moved back and forth in accordance with thickness of reamer material. The inside opening of vice varies corresponding to the sectional taper of the reamer material. The present invention also discloses a method of manufacturing a reamer which has an enlarged rake angle and a smaller relief angle than conventional reamers. This is accomplished by an inside opening dimension of the vice being a little larger than the sectional figure of the reamer material. When twisted, the twisting force is exerted adjacent to the angular edge of the face regarded as a relief face when the reamer material is twisted, and an angular portion of the edge of the reamer is squashed.

9 Claims, 24 Drawing Figures

PRIOR ART

TWISTING APPARATUS OF ROOT CANAL REAMER OR FILE MATERIAL AND METHOD FOR MANUFACTURING ROOT CANAL REAMER OR FILE

BACKGROUND OF THE INVENTION

1. Field of the Invention

The present invention relates to an apparatus for twisting root canal reamer material and a method for constructing the same. More specifically, the present invention concerns an apparatus for manufacturing a root canal reamer having a polygonal cross-section with a greater number of twists and a method of manufacturing same. Further, the present invention discloses a method and apparatus which work-hardens the exterior angular cutting edges of the root canal reamer while the interior remains flexible.

2. Description of the Prior Art

In the construction of conventional root canal reamers, austenitic stainless steel is ground to a very fine cylindrical shape having a triangular or quadrangular cross-section. The root canal reamer is then formed by twisting the stainless steel cylinder. To accomplish this, as shown in FIG. 1, the root portion of the reamer material 1 is held in chuck 2 and pinched with vice-claws 3. The vice-claws are then rotated and move along the reamer material. In order to better hold the sides of the reamer material 1, the vice-claws 3 can be provided with grooves 4. The sides are pinched by the grooves 4 or can be pinched by vice-claws 3 having finely formed tips, as shown in FIG. 3.

It is difficult to assure unified, accurate twisting pitch throughout the reamer. Due to the extreme thinness of the root canal reamer, the prior methods do not provide accurate positioning of the claw 3 on reamer material 1 nor do they assure dimensioned accuracy of groove 4. Where one side of a square reamer has a length of approximately 0.04 mm, the chances are increased that the reamer material will be damaged or simply fail to be twisted. With such fine reamer material the neighboring claws may abut against one another without grasping the reamer material. The claws may also cause scratching or scoring of the reamer material.

A root canal reamer of satisfactory cutting quality should have a positive rake angle as defined later, formed in the twisting process. The resulting root canal reamers are shown in cross-section in FIGS. 4 and 5. As illustrated, the resulting rake angles are all negative. FIG. 4 designates minus 45 degrees. FIG. 5 designates minus 30 degrees (d designates a rotating direction of the reamer and c designates canal wall).

The reamer must be manufactured to avoid breakage or shearing. To accomplish this, the reamer material is work-hardened. The usual work-hardening process compresses the reamer material along each flat face producing uniform work-hardening throughout. This causes flexibility and makes the finished reamer susceptible to breakage. Because the vice-claws must conform to the faces of the reamer material, it is impossible to twist square reamer material in anything but square vice-claws. Furthermore, creating smaller sectional area by compression increases the cost of manufacture while the face-to-vice-claw relationship makes it difficult to produce a cutting face having a concave shape.

SUMMARY OF THE INVENTION

The present invention, which will be described in greater detail subsequently, involves a method for manufacturing a root canal reamer and a root canal reamer so produced having a novel structure which combines improved cutting qualities with increased shear strength and flexibility. The improved reamer has an enlarged rake angle and diminished relief angle along with a concave surface extending along a portion of the reamer face contiguous to each cutting edge. The enlargement rake angle and concurrent decrease in the relief angle presents a more efficient cutting surface than the more blunt cutting edge present in the prior art. The finished reamer has a spiral series of twists opposed to the rotational direction of the finished reamer. The enlarged rake angle corresponds to the rotational direction. The improved reamer may be tapered to provide efficient, accurate cutting. It may also have different regions made up of various angular cutting edges.

The method for manufacturing a root canal reamer of the novel configuration involves twisting the reamer material while it is held in a vice. While the reamer material is twisted the vice mechanically retracts permitting twisting along the length of the reamer material. The number of twists introduced in the reamer material can be varied by varying the vice retraction rate.

The vice is composed of independently movable claws held in tension against each other such that a portion of the face of one claw abuts the side portion of the adjacent claw. Together the claws form an opening into which the reamer material is placed. The opening may be triangular, quadrangular or any other shape desired depending on the number of vice claws used. The opening need not be equilinear. One or more of the claws may be fixed while the others vary in one or more directions to correspond to the cross-section of the reamer material. By limiting one or more of the degrees of freedom of the non-fixed claws, various polygonal shapes can be achieved.

The vice opening is slightly larger than the cross-section of the reamer material to be prepared. Rather than contacting an entire face of the reamer material, the vice claw contacts an angular edge. The angular edge is bent by the twisting motion of the reamer forming an enlarged rake angle, a diminished relief angle and a concave surface contiguous to the relief angle.

The angular edges of the reamer material are compressed as they are bent. This results in localized work-hardening at the cutting edges while flexibility at the core of the finished reamer is retained.

It is an object of this invention to provide an improved root canal reamer having a series of positively oriented spiral twists in which the cutting edge is characterized by an enlarged rake angle and a diminished relief angle.

It is a further object of this invention to provide an improved root canal reamer on which the cutting edges have been work-hardened while the central core remains non-work-hardened and flexible.

It is a further object of the present invention to provide an apparatus for manufacturing root canal reamers in which the root canal reamer material is rotated while the vice retracts along the length of the material.

It is another object of the present invention to provide an arrangement of multiple movable vice-claws which form an opening sightly larger than the reamer material such that the angular edges of the reamer material are twisted and compressed by contact with the vice-claw faces.

It is yet another object of the present invention to provide a root canal reamer twisting apparatus which has a series of vice-claws forming an opening in their center which can be varied according to size and shape.

BRIEF DESCRIPTION OF THE DRAWINGS

In order to better illustrate the present invention applicable prior art is discussed and illustrated in FIGS. 1–5 in which:

FIGS. 6–23 illustrate features of the present invention in which:

FIG. 6 is a schematic drawing of root canal reamer manufacturing apparatus of the present invention;

FIG. 7 is an explanatory drawing of the vice in which four vice-claws of the present invention are used;

FIG. 8 is an arrangement drawing of four vice-claws of the present invention;

FIG. 9 is an explanatory drawing of operation of four vice-claws of the present invention;

FIG. 10 is an explanatory drawing of the vice which three vice-claws of the present invention are used;

FIG. 11 is an explanatory drawing of the operation of three vice-claws of the present invention;

FIG. 12 is an explanatory drawing in the case which the vice-claws of the present invention are formed with roller-like claws;

FIG. 13 is an explanatory drawing in which a relation between the reamer material and the vice-inside is indicated in order to manufacture a reamer of quadrangular section of the present invention;

FIG. 14 is an explanatory drawing of a state in which the reamer material is twisted by the relation of FIG. 13;

FIG. 15 is an explanatory drawing in which a relation between the reamer material and the vice-inside is indicated in order to manufacture a reamer of triangular section of the present invention;

FIG. 16 is an explanatory drawing of a state in which the reamer material is twisted by the relation of FIG. 15;

FIG. 17 is an explanatory drawing of the vice, the position of which is varied corresponding to the portion of reamer material of the present invention which is twisted;

FIG. 18 is a sectional view taken substantially along the lines A—A of FIG. 17;

FIG. 19 is a sectional view taken substantially along the lines B—B of FIG. 17;

FIG. 20 is a longitudinal sectional view of usual root canal reamer;

FIG. 21 is a longitudinal sectional view of the root canal reamer of the present invention;

FIG. 22 is an explanatory drawing in the case where the vice-inside of the present invention is formed with a right-triangle; and FIG. 23 is an explanatory drawing in the case where the vice-inside figure of the present invention is formed with a parallelogram and a reamer material having a lozenge-shaped cross section is twisted.

DETAILED DESCRIPTION OF THE PREFERRED EMBODIMENTS

Figure 6:
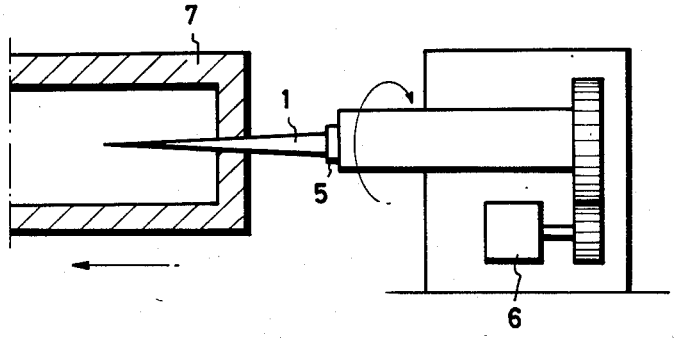
PRIOR ART FIG.6

FIG. 6 is a schematic depiction of the root canal reamer manufacturing device of the present invention. The reamer material 1 has a multi-angular cross-section of either a triangle, rectangle or other geometric shape. A chuck 5 which holds the reamer material in position is rotated by a motor 6.

A multi-sided vice 7 contacts a portion of each of the respective sides of the reamer material 1. The advance and retreat of the vice 7 along the reamer material 1 actuated by cam action or the like occurs while the reamer material is twisted by rotation motor 6.

Figure 7:
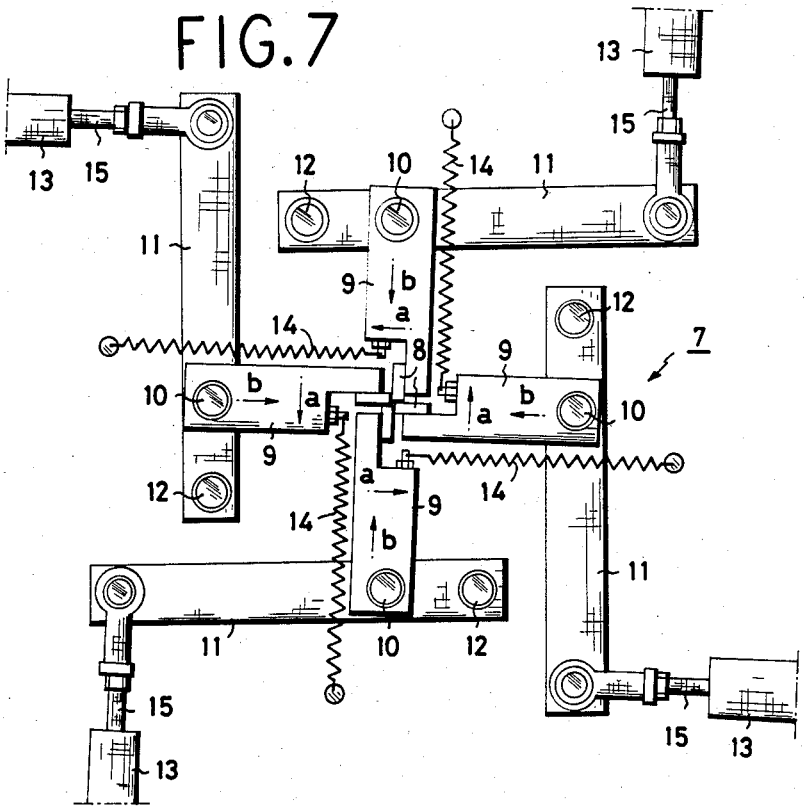
Figure 8:
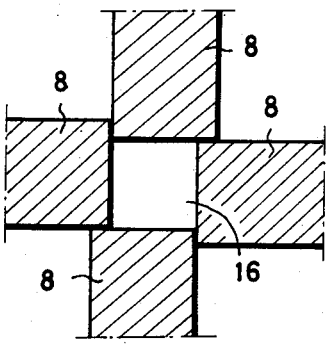

As shown in FIGS. 7 and 8, the vice 7 is arranged so that a portion of front face of each vice-claw 8 abuts the side of a neighboring vice-claw 8. Each first arm 9 holds a vice-claw 8 and is installed on a second arm 11 to be able to rotate about a fulcrum 10. The second arm 11 is also rotatably positioned with a fulcrum 12 and a cylinder 13 arranged on opposed ends. Spring 14 is installed to arm 9 and attached to an exterior stationary position to hold the vice-claw 8 in position relative to the other vice-claw assemblies.

The side of claw 8 presses on the front face of the neighboring claw 8 because of the biasing force exerted by spring 14 pulling the respective arms 9 in the direction of arrow "a" as shown in FIG. 7. Each arm 9 is advanced by an advancing piston 15 through the actions of the cylinder 13. Consequently, when the sides of the reamer material 1 are pressed by advancing the claws 8 in the direction of arrow "b" in the drawing, the reamer materials 1 are held to prevent free rotation. At this point force a is less than force b.

The apparatus can be used to manufacture root canal reamers in the following manner. One end of reamer material 1 is clamped by chuck 5. As shown in FIG. 8, the other end of the reamer material 1 is then inserted into opening 16 located in vice 7. The opening 16 is formed by vice-claws 8. The claws are positioned so that the diameter of the opening is slightly larger than the diameter of the root canal reamer. The vice 7 and the chuck 5 are kept at a relative distance while the claws 8 are pressed in the direction of b by the cylinders 13 and the chuck 5 is then rotated. The jaws retract as the reamer material is twisted. Even if the reamer material 1 tapers, the claws 8 advance for some time by adjusting to it. The opening 16 of vice 7 becomes correspondingly smaller while holding the reamer material for twisting regardless of the taper.

Figure 9:
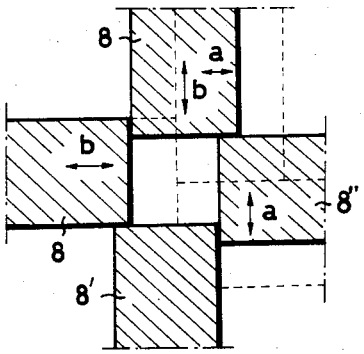

FIG. 7 presents a configuration in which four cylinders 13 are used. In an alternate embodiment, shown in FIG. 9, one claw 8' among the four is completely fixed. Neighboring claw 8'' is free to move in the sidewise "a" direction and is unable to move in the "b" direction. Claw 8''' is fixed to permit movement in the "b" direction only while claw 8 has freedom of motion in both directions. Thus, the dimensions of the opening 16 of the vice 7 can be varied by two cylinders 13 making it possible to vary the dimension of the opening 16 more precisely to correspond to the sectional figure of the reamer material 1.

Figure 10:
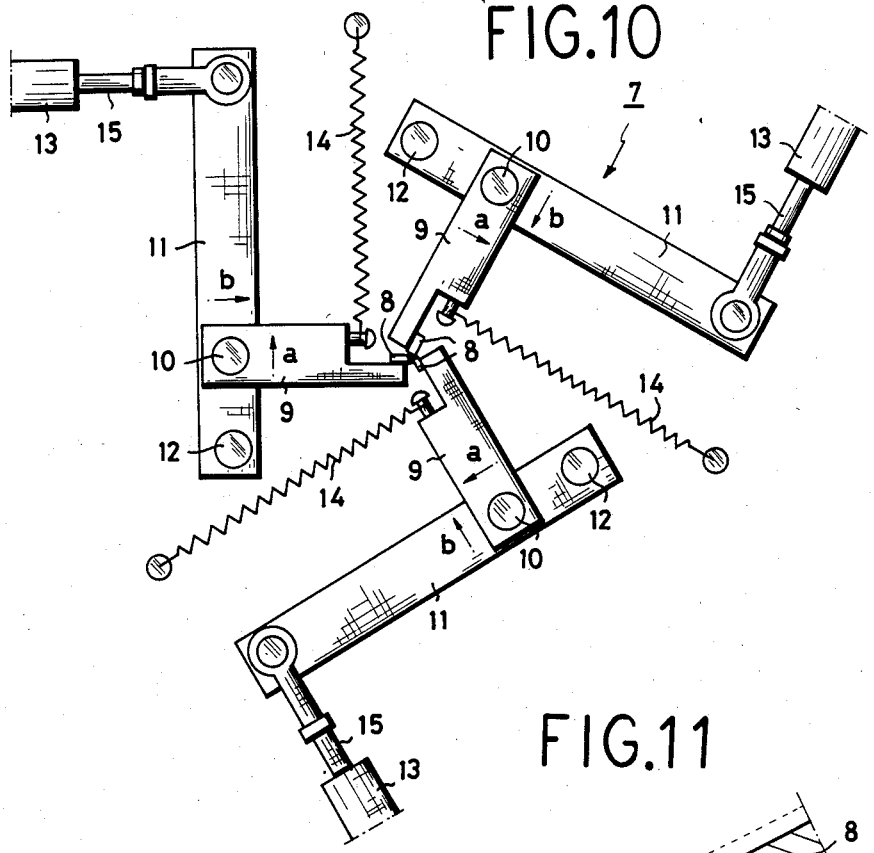
Figure 11:
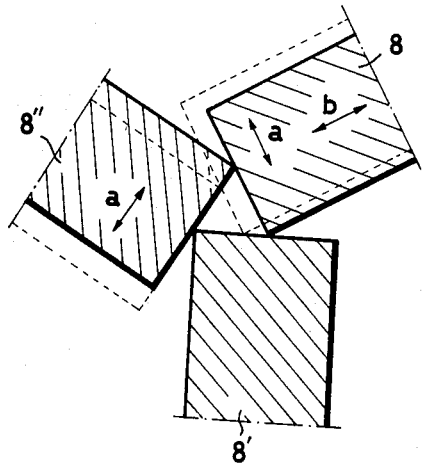
Figure 12:
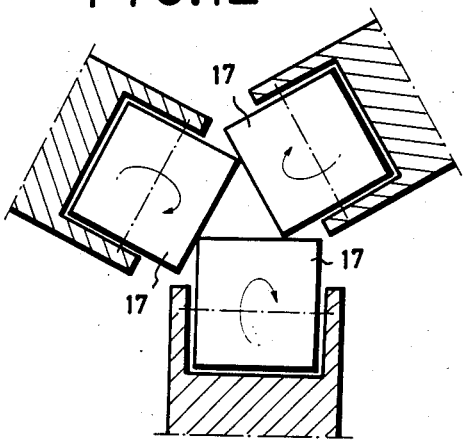

If three vice claws 8 are used, the opening 16 will be triangular as shown in FIG. 10. Reamer material 1 with a tapered triangular cross-section can be twisted using this device. As shown in FIG. 11, if one claw 8' is fixed and another claw 8'' is anchored allowing no movement in the "b" direction, the dimensions of the orifice 16 can be varied by one cylinder 13. Some variation in the dimensions of opening 16 can be caused by rotatory movement of the arms 9 and 11, respectively in the directions of both a and b together. However, the movement is minute and the variation to opening 16 caused by the arms can be disregarded. Equipping the claws with rotatable roller-like elements 17, as shown in FIG. 12, allows smooth retraction of vice 7.

The twisting apparatus provides a means for the manufacture of a root canal reamer having an enlarged rake angle as defined below and a compressed relief angle. Where canal reamer material 1 has a quadrangular cross section, the vice 7 having four vice-claws 8 as shown in FIG. 7 is used. The dimensions of the opening 16 are slightly larger than the cross-section of the reamer.

Figure 13:
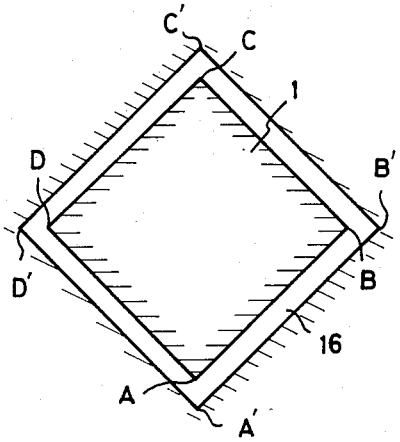
Figure 14:
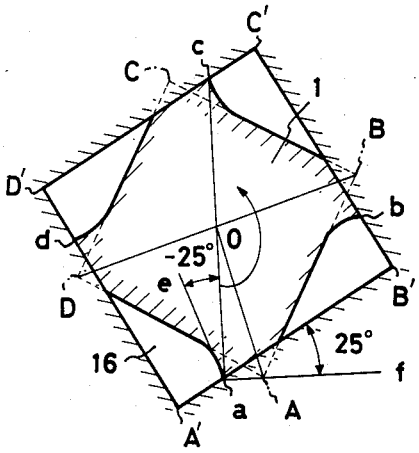

While the reamer is twisted and the vice retracts down the length of the reamer, the relation between the cross-section of the reamer material 1 and the opening 16 is maintained. As seen in FIGS. 13 and 14, the angular ends A, B, C and D of the reamer material 1 are twisted against the vice-claws. The twisting force presses the angular ends in the opposite direction of the rotation of the chuck. A reamer with a cross-section designated by polygon a, b, c and d is formed. In angular ends A, B, C and D of the edges, relief angles are curved inside in proximity to angular portions of the edge, while rake angles are bent outside in angular portions of the edge. Segments ac and bd designate fixed axial diameters (diameters of a circumscribed circle).

Figure 1:
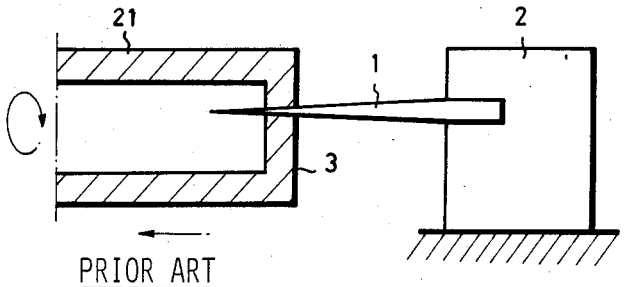
FIG. 1 is a schematic drawing of the reamer manufacturing apparatus of the prior art.
Figure 2:
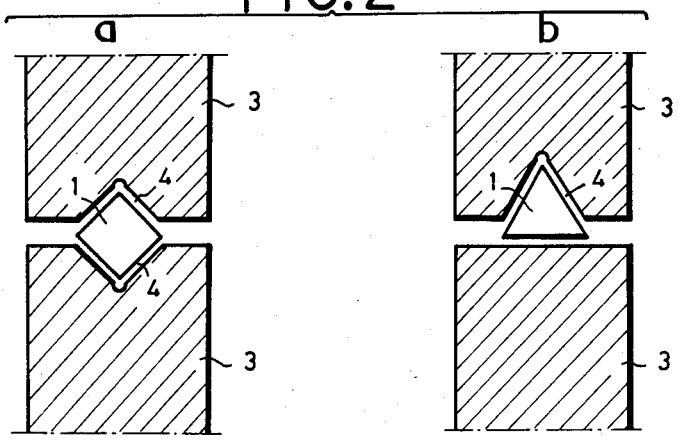
PRIOR ART FIG.2
FIG. 2*a* is a cross-sectional view along the 2—2 line of conventional vice-claws which are divided into two parts and contain quadrangular reamer material.
FIG. 2*b* is a cross-sectional view along the 2—2 line of conventional vice-claws which are divided into two parts and contain triangular sectioned reamer material.
Figure 3:
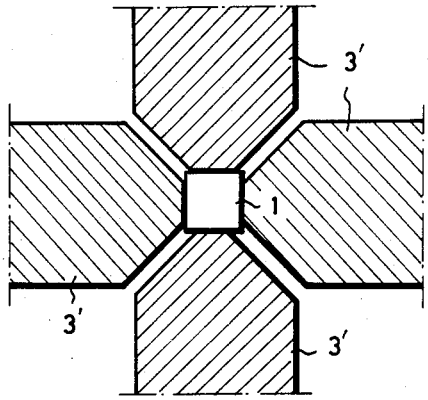
PRIOR ART FIG.3
FIG. 3 is a cross-sectional view along the 2—2 line of conventional vice-claws divided into four parts as used in prior art.
Figure 4:
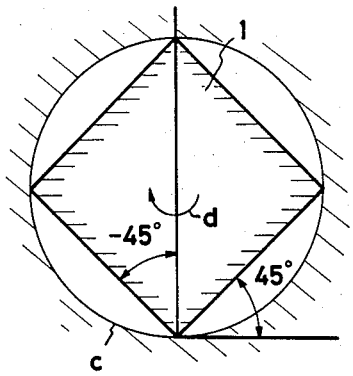
FIG. 4 is a diagram of conventional root canal reamer of quadrangular cross-section as would occur in prior art.

The rake angle ∠oae, as depicted in FIG. 14, is larger than conventional negative rake angle of −45 degrees as shown in FIG. 4. The enlarged rake angle facilitates an outflow of scraps created during cutting while decreasing cutting resistance. As is shown in FIG. 14, the rake angle is that angle between a tangent to the curved cutting edge at its point of contact with the vice-claw and the radius of the circumscribed circle which passes through the point of tangency. Also, the relief angle is that angle between a tangent to the circumscribed circle passing through the cutting edge and the vice-claw.

In the present embodiment, FIGS. A' B' C' D' formed by the opening 16 is related to body ABCD such that rake angle ∠oae designates approximately 25 degrees and relief angle ∠B'af designates approximately 25 degrees. Angle ∠eaB' becomes as follows:

$$\angle oae + \angle oaB' = 25° + 65° = 90°$$

The new angle is still 90°, unchanaged from the angle of the edge found in conventional art. However, the strength of the edge has increased due to the applied force necessary to form the twisted shape. The force creates a localized work-hardening at the angular edges. Cutting the root canal wall can be performed more satisfactorily because of this. Because of the localized application of force, the central portion of the reamer is not as work hardened as would occur in conventional reamers. Therefore, strength increases in portions of the edge without loss of flexibility and tenacity in the body of the reamer itself.

Figure 5:
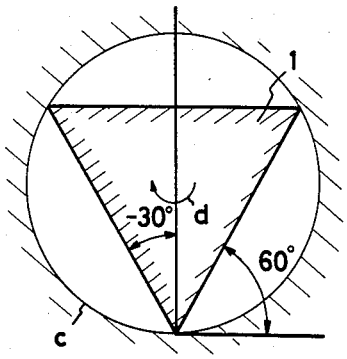
PRIOR ART FIG.5
FIG. 5 is a diagram of conventional root canal reamer of triangular cross-section as would occur in prior art.
Figure 15:
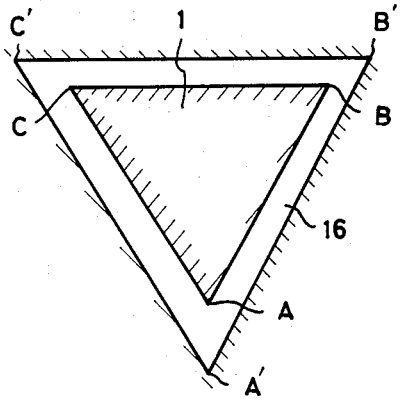
Figure 16:
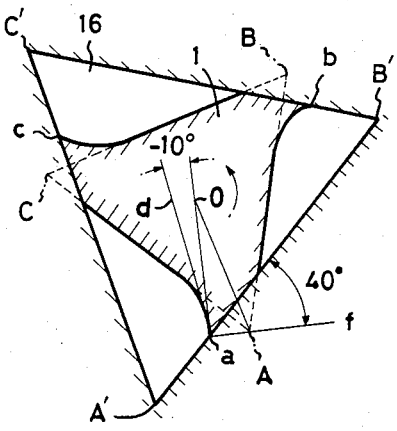

A reamer material of triangular cross-section can be manufactured by a similar method with similar accrued benefits. In the case of a cross-sectional triangle, the vice 7 having three vice-claws 8 as shown in FIG. 10 is used. As shown in FIG. 15, the reamer material is twisted by forming the opening 16 with a slightly larger dimension than the cross-section of reamer. The angular ends A, B and C of the edges of the reamer material 1 are pressed in the opposite direction to rotation of the chuck as shown in FIG. 16. A compression occurs as reamer material is twisted and a section of polygon a b c is formed. The rake angle ∠oad is larger than the −30° of the conventional rake angle shown in FIG. 5. A fixed axial diameter (diameter of circumscribed circle) of the reamer is two times as long as a segment of a line oa joining center o to angular portion a.

In this embodiment, the size of the vice-inside FIGS. A' B' C' is established in order that rake angle ∠oad is approximately 10° and relief angle ∠B'af is approximately 40°. The angle ∠daB' becomes:

$$\angle oad + \angle oaB' = 10° + 50° = 60°$$

The angle remains unchanged from the conventional art. The benefits of this process are similar to those which accrue in the quadrangular cross-sectional material.

Since the size of the vice-inside opening 16 is analogous to the section of the reamer material 1, the diameter of a circumscribed circle is larger than a diameter of the finished reamer. Similarly, the diameter of an inscribed circle is smaller than the diameter of the finished reamer. With reference to the circumscribed and inscribed circles in the case of the cross-sectional triangle, the circumscribed circle is the smallest one of the circles passing the three apexes, and the inscribed circle is the largest one in the circles coming in contact with the three sides.

Where the reamer material 1 has a taper-like shape, especially where the root portion of the reamer material 1 differs from the tip portion of the reamer material, the dimension of the opening 16 must vary gradually to maintain contact between the reamer material 1 and the vice-claws 8. If a profiling mold is used which conforms with the taper of the reamer material 1, a displacement adapted to the taper of the reamer and the necessary collapsing volume of the edge can be produced. Changes in the reamer material dimensions will result in changes in the opening 16 dimension through the action of pistons 15.

Figure 17:
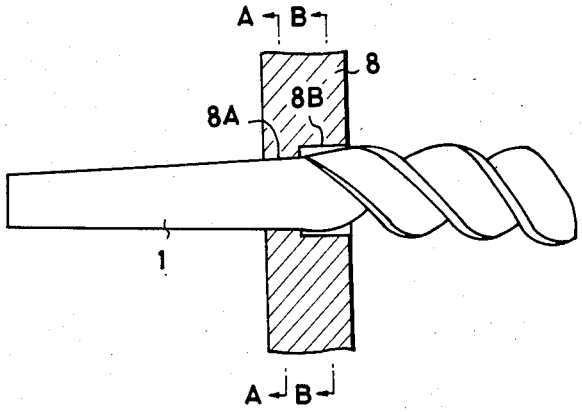

Alternately, a measuring portion 8A, which conforms to the size of the reamer material, and a working portion 8B, which has a slightly larger dimension, projected to the tip of the vice-claw 8 are arranged as shown in FIG. 17. Measuring portion 8A measures the size of the reamer material 1 for twisting portion (a distance from center to side). Because 8B has a larger fixed dimension, a twisting force is then applied within a short distance of the edge of the relief face.

Figure 18:
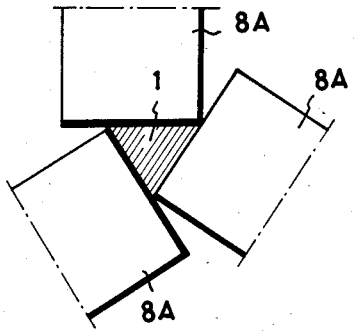
Figure 19:
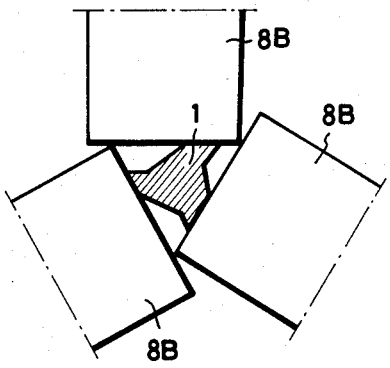
Figure 20:
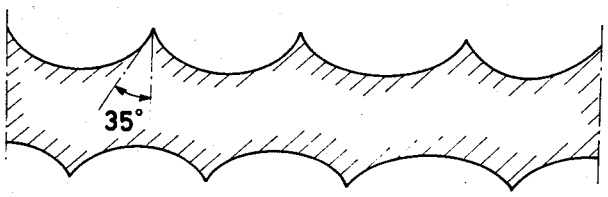
Figure 21:
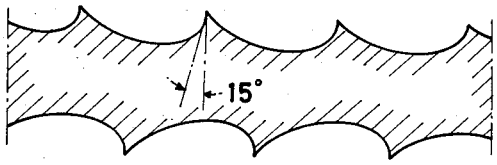

It is also possible to twist the reamer material 1 while the angular portion of the edge is compressed. The tips of respective claws 8 of the vice 7 are provided with measuring portions A and working portions B, the reamer material 1 is held by the measuring portions A, as shown in FIG. 18. The reamer material 1 is twisted as shown in FIG. 19 by the opening 16 which is formed by the working portions B. Consequently the reamer having an improved rake angle and relief angle is manufactured.

In the above-mentioned embodiment, the correspondence of the opening 16 to a size of the reamer material 1 can be formed by a difference in levels between the measuring portion A and the working portion B of the vice 7. Alternately, measuring portion A and working portion B may be equipped with electric or photoelectric sensors to determine the appropriate size of opening 16.

The method set forth discusses uniform improvements of the rake angle and the relief angle on the entire reamer material 1. It is also possible to modify the manufacturing apparatus to produce a reamer in which only the tip portion is greatly improved. Conversely, a reamer in which the root portion is greatly improved with respect to the tip portion and can be manufactured. Such special purpose root canal reamers would be used for particular dental procedures. As an example, reamers could be formed in which the reamer serves the special purpose of filling or shaving the canal.

Figure 22:
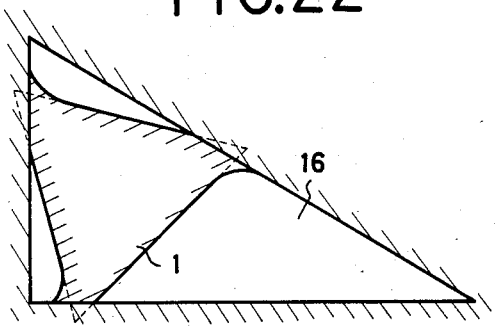

By varying the shape of the opening 16 from a equilateral triangle or a square the rake angle of one or more of the angular edges can be varied without sacrificing cutting quality. For example, as shown in FIG. 22, the opening 16 formed as a right-angled triangle having one angle of 60 degrees can twist the reamer material 1 having a regular triangular crosssection. The same rake angle and relief angle as occurs when the reamer is twisted by the opening 16 having a regular triangle are formed in two cutting edges. The third cutting edge is formed with different rake angle and relief angle from that of other two.

Figure 23:
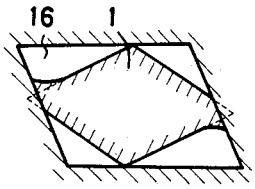

As shown in FIG. 23, the opening 16 formed with a parallelogram can twist the reamer material 1 having a lozenged cross-section. Consequently, improved relief angles are formed on two cutting edges only. The reamer material 1 and the opening 16 are not limited to the regular triangular or square cross-section. The cross-sections can be an isosceles triangle, a lozenge and a rectangle, and also a polygon having a partial curve.

In the present invention, the adjacent vice-claws are arranged alternately. Because of this, the reamer material 1 can be held securely without concern for the initial accuracy of insertion. It is possible that the reamer can then be twisted without damaging the edge. Furthermore, if the section of the reamer material becomes extremely thin as the reamer material tapers, it is possible that the vice-inside figure can vary accordingly. Because of this, the claws need not be replaced with every variance in reamer thickness. The reamer can be twisted accurately with a fixed pitch up to the extreme tip of the taper. Also, if the reamer is twisted while maintaining a fixed ralation between the vice-inside opening and a sectional figure of the reamer by the twisting apparatus of the present invention, only the angular portion of the edge is compressed. It is possible to manufacture a root canal reamer with an improved rake angle and the relief angle manufactured together with a work hardening process. This manufacturing device and method provides a root canal reamer having more satisfactory cutting quality then the usual reamer currently available.

What is claimed is:

1. An apparatus for twisting root canal reamer material, the material having a plurality of angular edges and a root portion comprising:

a chuck portion holding a root portion of a reamer material;

a vice having a plurality of vice-claws each of which being pivotally connected to a cylinder and piston means, each having front and side portions, the front portion being planar and capable of pressing the respective angular edges of the reamer material, said vice and chuck being positioned a distance from one another and being oriented to hold said reamer material at spaced positions along its longitudinal axis;

means for rotationally varying the distance between the vice-claws and the chuck portion;

the vice-claws being movable in a plane perpendicular to the longitudinal axis of the reamer in relation to each other and to the reamer material complying with variations in the thickness of the material; and the vice-claws being positioned so that each vice-claw presses a portion of the front of the adjacent vice-claw.

2. The apparatus of claim 1 wherein the vice-claw is comprised of a roller-like rotatable contacting portion which is rotated by contact with said reamer material moving in an axial direction.

3. The apparatus of claim 1 wherein the arrangement of the vice-claws forms an opening in the vice:

having a maximum axial diameter equal to or slightly larger than the axial diameter of the reamer material, and a maximum axial diameter equal to the axial diameter of the finished reamer.

4. A method for manufacturing a root canal reamer material having a cross section with angular edges, a rake angle and a relief angle comprising the steps of:

employing an apparatus having a chuck portion holding the root portion of material, and a vice having a plurality of vice-claws the arrangement of which forms a vice-inside opening each vice-claw having a planar surface, the vice being positioned a distance from the chuck;

locating the reamer in the chuck portion;

inserting reamer material having an angular cross-section into the opening in the vice;

applying an external force by the vice-claws to the angular edges of said cross section of the reamer material by contacting each edge with a respective planar surface of each vice-claw in a manner that the surfaces establishing each angular edge makes initial contact with the planar surface of a respective vice-claw with the angular edge surfaces and vice-claw surface being nonparallel to one another;

rotationally varying the distance between the vice and chuck so as to twist the reamer material relative to the vice-claws while the angular edges of the reamer are forced and shaped by the planar surface and thus work hardened in the direction of said external force; and wherein the external force applied to the reamer compresses the angular cross-sectional shape of the reamer such that the axial diameter of the finished reamer is smaller than that of the root portion of the reamer.

5. The method of claim 4 further comprising the steps of:

compressing the angular portions of the reamer angular edges;

moving the reamer with respect to the opening, said opening in the vice having a circumscribed circular diameter larger than the axial diameter of the finished reamer and an inscribed circular diameter smaller than the axial diameter of the finished reamer.

6. The method of claim 5 wherein the reamer moving step comprises moving the reamer with respect to the opening, said opening in the vice having a configuration similar to a cross-section of the reamer material.

7. The method of claim 5 wherein the reamer moving step comprises moving the reamer with respect to the opening, said opening in the vice having a configuration dissimilar to a cross-section of the reamer material.

8. The method of claim 5 wherein the reamer moving step comprises moving the reamer with respect to the opening, the interior dimensions of which freely vary to correspond with a position of the longitudinal direction of the reamer.

9. The method of claim 8 wherein the reamer moving step comprises moving the reamer with respect to the openings, the interior dimensions of which vary to correspond with the size of the cross-section of the portion of the twisted reamer material.

* * * * *